US012152388B2

(12) United States Patent
Magin et al.

(10) Patent No.: US 12,152,388 B2
(45) Date of Patent: Nov. 26, 2024

(54) BRACKET FOR ANGLED CEILING PANELS AND CEILING PANEL SYSTEM

(71) Applicant: CertainTeed Ceilings Corporation, Malvern, PA (US)

(72) Inventors: Michael Magin, Cumming, GA (US); Samuel Carrillo Lacouture, Lawrenceville, GA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 191 days.

(21) Appl. No.: 18/055,834

(22) Filed: Nov. 15, 2022

(65) Prior Publication Data

US 2023/0151607 A1 May 18, 2023

Related U.S. Application Data

(60) Provisional application No. 63/279,910, filed on Nov. 16, 2021.

(51) Int. Cl.
*E04B 9/22* (2006.01)

(52) U.S. Cl.
CPC ..... *E04B 9/225* (2013.01)

(58) Field of Classification Search
CPC ..... E04B 9/225; E04B 9/0478; E04B 9/064; E04B 9/068; E04B 9/127; E04B 9/241; E04B 9/28; E04B 9/363; E04B 9/366
See application file for complete search history.

(56) References Cited

U.S. PATENT DOCUMENTS 4,402,171 A 9/1983 Snyder
7,637,065 B2 * 12/2009 Ahren ..... E04B 9/225 52/713
9,663,948 B2 5/2017 Lehane
(Continued)

FOREIGN PATENT DOCUMENTS

CN 101787761 A 7/2010
CN 207812803 U 9/2018
(Continued)

OTHER PUBLICATIONS

International Search Report and Written Opinion, PCT Application PCT/US2022/079908, mailed Mar. 24, 2023.
(Continued)

*Primary Examiner* — Rodney Mintz
(74) *Attorney, Agent, or Firm* — McDonnell Boehnen Hulbert & Berghoff LLP

(57) ABSTRACT

The present disclosure relates generally to ceiling panel brackets, for example, suitable for forming a ceiling surface by supporting a plurality of ceiling panels. The present disclosure relates more particularly to a bracket configured to couple a ceiling panel to a ceiling grid. The bracket includes a support arm configured to extend over a first flange of a T-beam of the ceiling grid and an attachment wall extending up from the support arm. The attachment wall is configured to be secured to a web of the T-beam. A leg extends down from the support arm so as to hang below the T-beam. A foot is coupled to the leg and configured to be attached to the ceiling panel. The foot is disposed at a first angle with respect to the support arm so as to hold the ceiling panel at an angle to the ceiling grid.

19 Claims, 8 Drawing Sheets

(56) References Cited

U.S. PATENT DOCUMENTS

| | | | | |
|---|---|---|---|---|
| 10,294,664 | B2 * | 5/2019 | Bergman | E04B 9/205 |
| 10,386,712 | B1 | 8/2019 | Yett | |
| 11,211,040 | B2 * | 12/2021 | Czech | F21V 23/003 |
| 2007/0101670 | A1 * | 5/2007 | Ahren | E04B 9/225<br>52/522 |
| 2008/0204369 | A1 | 8/2008 | Brown | |
| 2016/0102454 | A1 * | 4/2016 | Lehane | E04B 9/127<br>52/506.07 |
| 2018/0002926 | A1 | 1/2018 | Bergman | |
| 2019/0088241 | A1 | 3/2019 | Czech | |

FOREIGN PATENT DOCUMENTS

| | | | | |
|---|---|---|---|---|
| CN | 208039594 | U | 11/2018 | |
| DE | 4229712 | A1 * | 3/1993 | E04B 1/8209 |
| JP | 2016-223074 | A | 12/2016 | |

OTHER PUBLICATIONS

Modular Aluminum Baffle Ceiling System, 1-11 pages, Nagar, New Delhi, India, available at https://iqubx.com/aluminium-sound-baffle-ceiling-system/, accessed Sep. 28, 2021.

* cited by examiner

BRACKET FOR ANGLED CEILING PANELS AND CEILING PANEL SYSTEM

CROSS-REFERENCE TO RELATED APPLICATIONS

This application claims the benefit of priority of U.S. Provisional Patent Application No. 63/279,910, filed Nov. 16, 2021, which is hereby incorporated herein by reference in its entirety.

BACKGROUND OF THE DISCLOSURE

1. Field of the Disclosure

The present disclosure relates generally to ceiling panel brackets, for example, suitable for forming a ceiling surface by supporting a plurality of ceiling panels. The present disclosure relates more particularly to a carrier for supporting ceiling panels at an angle.

2. Technical Background

Panels are convenient and effective for constructing architectural surfaces. The panels may be pre-fabricated and shipped to the construction location, allowing for efficient installation that covers a large surface area. If damaged, the panels can be wholly replaced, rather than requiring a custom repair of the architectural surface. In some cases, the panels can be removed to provide access to the area behind the panels.

Panels that are used to form an architectural surface, such as a ceiling, are often supported by a structural grid that holds the panels in place. This allows flexibility in the design of the panels, because the supporting grid provides the structural integrity needed for the architectural surface, thereby allowing the design of the panels to address aesthetic and acoustic requirements of the ceiling system. The panels are typically held in a row or an array to provide an attractive ceiling surface. Panels are often oriented either parallel to the grid so as to form a planar surface, or perpendicular to the grid, such as ceiling baffles. Other configurations are possible, but these are frequently achieved by either customizing the ceiling grid or by hanging the panels with wire from the grid at different lengths. While such building surface structures may be aesthetically interesting, they require the use of various custom configurations and complex installation, thereby increasing installation complexity and costs.

The present inventors have recognized that a ceiling system that allows for an alternative ceiling aesthetic without adding significant complexity in installation would be attractive to architects and builders.

SUMMARY OF THE DISCLOSURE

In one aspect, the present disclosure provides a bracket configured to couple a ceiling panel to a ceiling grid, the bracket comprising:

- a support arm configured to extend over a first flange of a T-beam of the ceiling grid;
- an attachment wall extending up from the support arm, the attachment wall being configured to be secured to a web of the T-beam;
- a leg extending down from the support arm so as to hang below the T-beam; and

- a foot coupled to the leg and configured to be attached to the ceiling panel, the foot being disposed at a first angle with respect to the support arm so as to hold the ceiling panel at an angle to the ceiling grid.

In another aspect, the disclosure provides a ceiling system comprising:

- a ceiling grid comprising a first T-beam including a web, a first flange extending laterally from the web, and a second flange extending opposite the first flange;
- a first bracket according to the disclosure coupled to the first T-beam; and
- a first ceiling panel having a first face and a second face opposite the first face, the first ceiling panel extending along a length from a first end to a second end and extending across a width from a first side to a second side, wherein the foot of the first bracket is attached to the first ceiling panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that a conventional ceiling system that allows for an alternative ceiling aesthetic without adding significant complexity in installation would be attractive to architects and builders.

Accordingly, one aspect of the disclosure is a bracket configured to couple a ceiling panel to a ceiling grid. The bracket includes a support arm configured to extend over a first flange of a grid beam. An attachment wall extends up from the support arm and is configured to be secured to a web of the grid beam. On the other hand, a leg extends down from the support arm so as to hang below the grid beam. A foot is coupled to the leg and is configured to be attached to the ceiling panel. The foot is disposed at a first angle with respect to the support arm so as to hold the ceiling panel at an angle to the ceiling grid.

Figure 1:
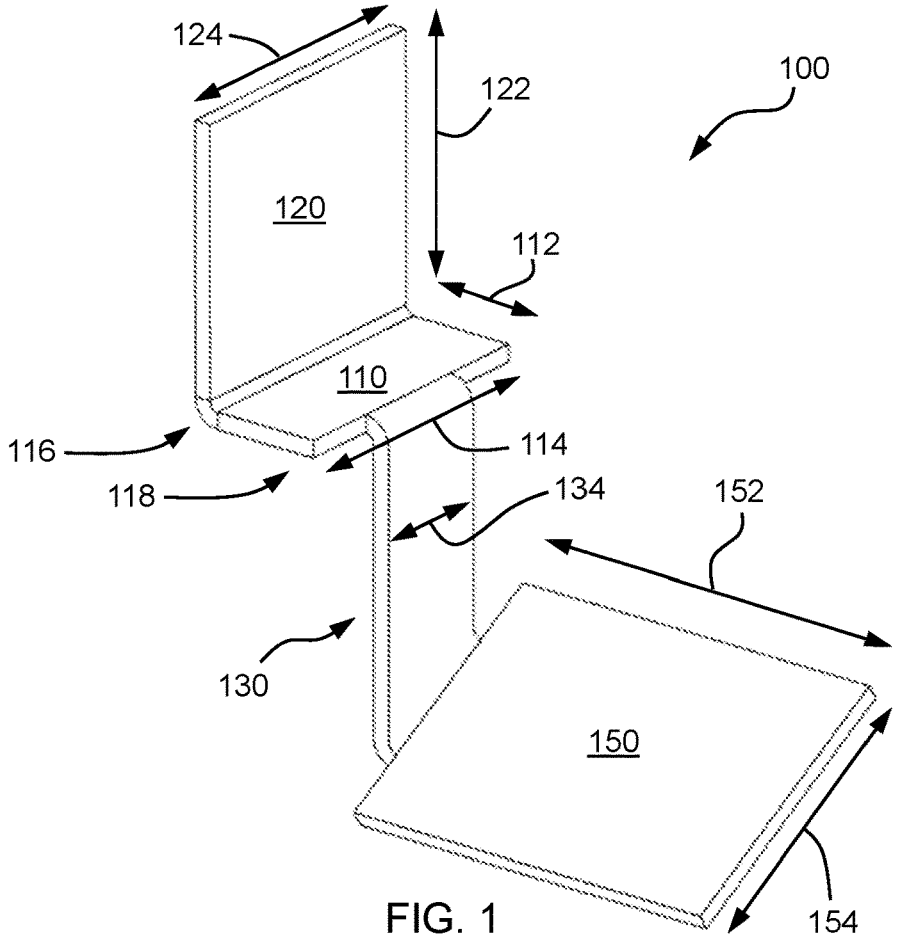
FIG. 1 is a schematic perspective view of a bracket according to an embodiment of the disclosure.
Figure 2:
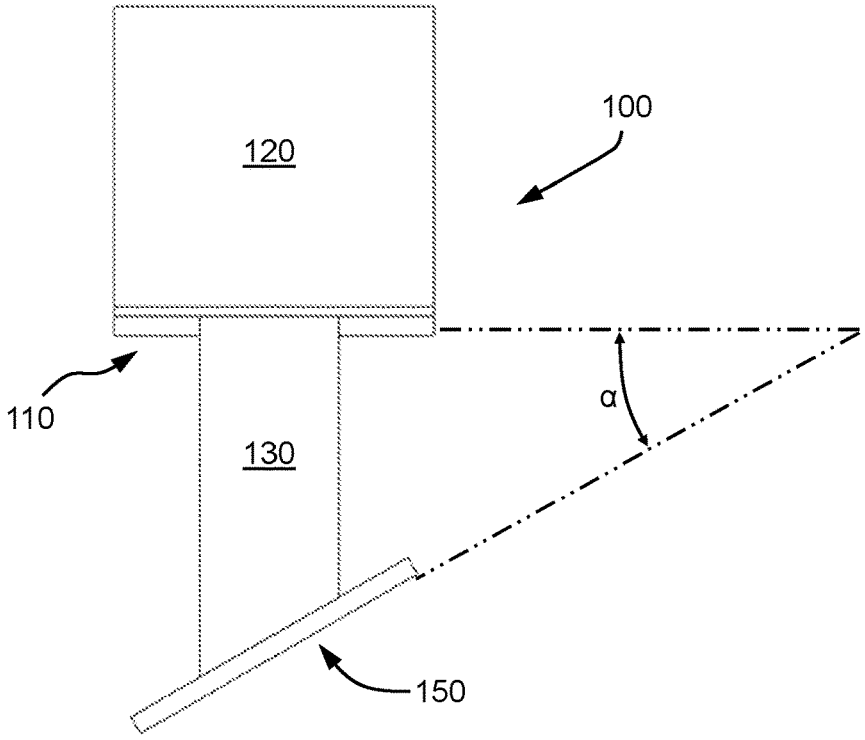
FIG. 2 is a schematic side view of the bracket of FIG. 1.
Figure 3:
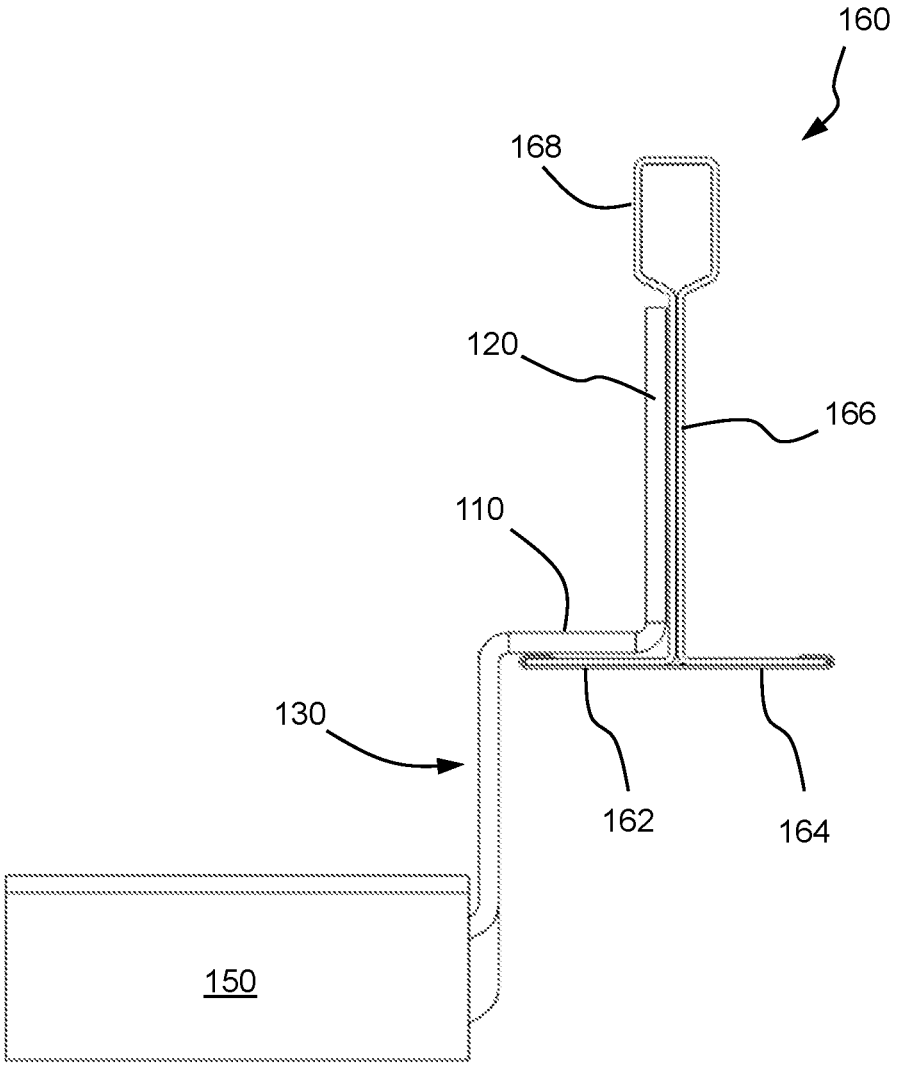
FIG. 3 is a front view of the bracket of FIG. 1 attached to a grid beam according to an embodiment of the disclosure.

Such a bracket is shown in perspective view in FIG. 1 and a side view in FIG. 2. Bracket 100 includes a support arm 110 configured to extend over a first flange of a grid beam, as explained further below. An attachment wall 120 extends up from support arm 110 and is configured to be secured to a web of the grid beam. Opposite attachment wall 120, a leg 130 extends down from support arm 110 so as to hang below the grid beam. A foot 150 is coupled to leg 130 and is configured to be attached to a ceiling panel. As shown in FIG. 2, foot 150 is disposed at a first angle $\alpha$ with respect to support arm 110 in order to hold the ceiling panel at an angle to the ceiling grid, as explained in more detail below. FIG. 3 shows a front view of bracket 100 secured to a grid beam 160. In particular, support arm 110 extends over a first flange 162 of grid beam 160 and attachment wall 120 is secured against web 166.

In another aspect, the disclosure provides a ceiling system that includes a ceiling grid with a first grid beam, a first bracket coupled to the first grid beam, and a first ceiling panel attached to the first bracket. The grid beam includes a web and a first flange extending laterally from the web. A first bracket according to the disclosure is coupled to the first grid beam. A first ceiling panel is coupled to the foot of the first bracket. The first ceiling panel has a first face and a second face opposite the first face. Moreover, the first ceiling panel extends along a length from a first end to a second end and extends across a width from a first side to a second side.

Figure 4:
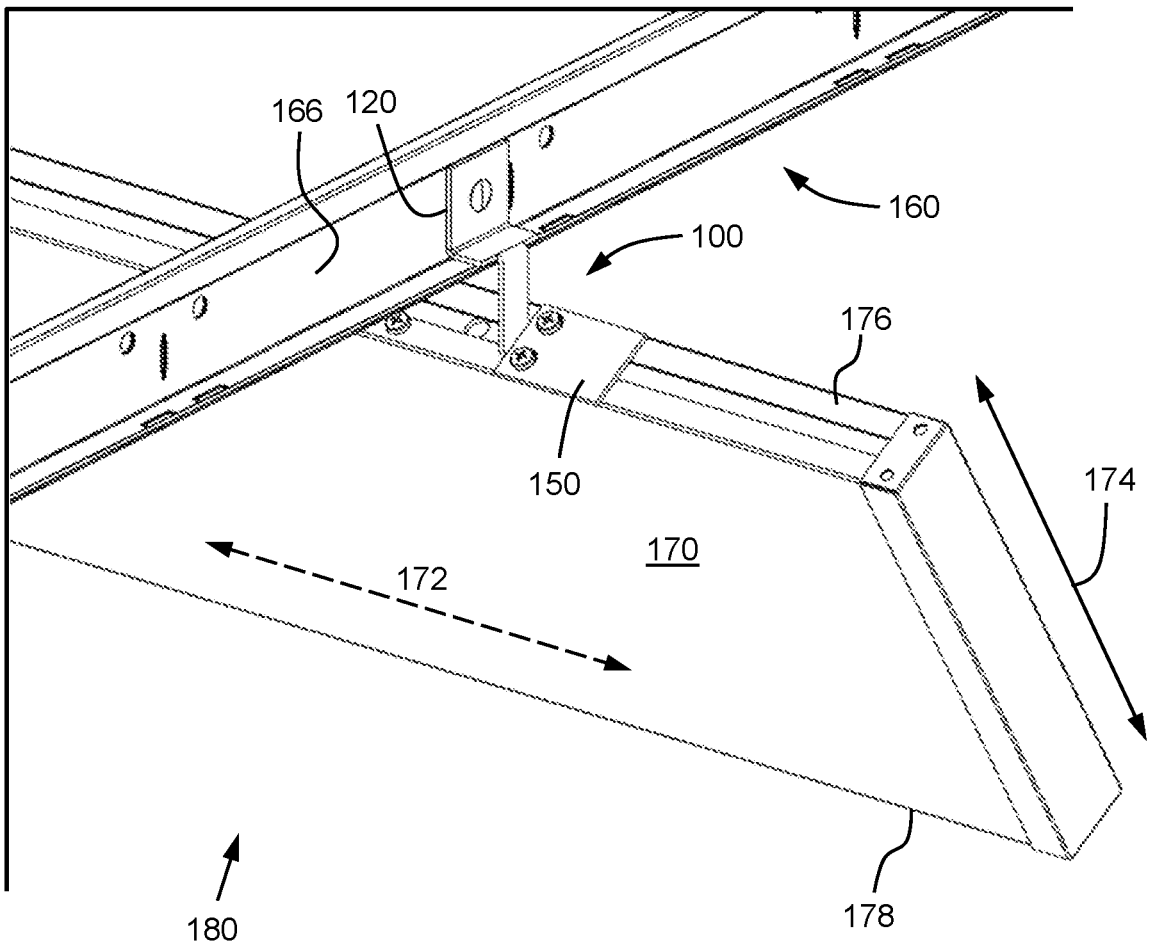
FIG. 4 is a schematic perspective view of a portion of a ceiling system including the bracket of FIG. 1 according to an embodiment of the disclosure.
Figure 5:
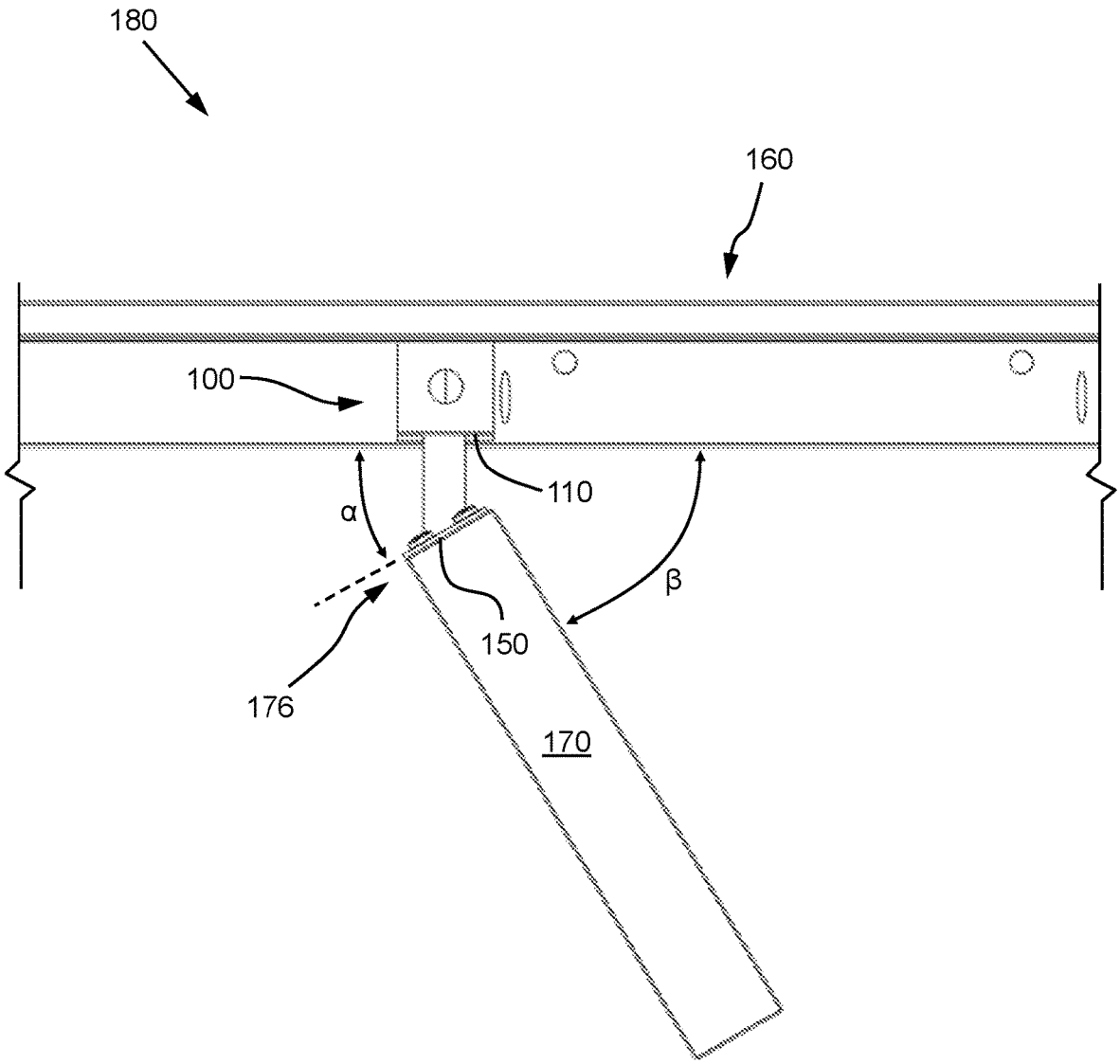
FIG. 5 is a side view of the portion of the ceiling system of FIG. 4.

A portion of such a ceiling system is shown in FIGS. 4 and 5. Ceiling system 180 includes first grid beam 160 with first bracket 100 coupled thereto. In particular, bracket 100 is positioned with support arm 110 and attachment wall 120 adjacent to first grid beam 160. Ceiling system 180 also includes a first ceiling panel 170 coupled to the foot 150 of bracket 100. Ceiling panel 170 extends along a length (indicated by direction 172) from a first end to a second end and extends across a width 174 from a first side 176 to a second side 178.

As shown in FIG. 1, support arm 110 of bracket 100 has a depth 112 that extends from an inner edge 116 to an outer edge 118 and a width 114 that is oriented so as to extend along the longitudinal direction of the grid beam when bracket 100 is attached thereto, as shown in FIG. 4. Attachment wall 120 extends upward from the inner edge 116 of support arm 110 over a height 122, and also has a width 124 that extends in the longitudinal direction of the grid beam. Leg 130 extends down from outer edge 118 and has a width 134. Because of the angle of foot 150, leg 130 is longer on one side than the other. Foot 150 extends away from leg 130 along a length 152 and has a width 154 that is runs perpendicular to length 152.

In certain embodiments of the ceiling system as otherwise described herein, the first grid beam is a T-beam. For example, as shown in FIGS. 3 and 4, first grid beam 160 is in the form of a T-beam that includes web 166 and first flange 162 extending laterally from web 166. As shown in FIG. 3, a second flange 164 also extends from web 166 opposite first flange 162. Further, first grid beam 160 is formed from a bent metal sheet that loops at the top to form a bulb 168, which provides structural stability to first grid beam 160. In other embodiments, the grid beams may have a different configuration, such as an extruded T-beam, with or without a bulb at the peak. Moreover, in some embodiments, the grid beams have a different shape that is not a T-beam, such as an I-beam or channel configuration.

In certain embodiments of the ceiling system as otherwise described herein, the attachment wall of the first bracket is secured against the web of the first grid beam. For example, as shown in FIG. 4, the attachment wall 120 of bracket 100 is attached against one side of web 166 of first grid beam 160. In ceiling system 180, attachment wall 120 is fastened to web 166 using a single fastener. In other embodiments, the attachment wall of the bracket is secured to the web of the grid beam using two or more fasteners. Further, in other embodiments, the attachment wall is bonded or adhered to the web of the grid beam. Still, in other embodiments, the grid beam and attachment wall may have interlocking configurations. For example, in some embodiments, the web may include clips, hooks, or apertures, and the attachment wall may include clips, hooks or apertures that mate with the corresponding structure of the web.

In certain embodiments of the ceiling system as otherwise described herein, at least a portion of the support arm of the first bracket is supported by the first flange of the first grid beam. For example, as shown in FIG. 3, support arm 110 rests on first flange 162 such that first flange 162 provides vertical support to bracket 100. In some embodiments, the support arm is substantially parallel with the first flange and is supported across the depth of the flange from the outer edge to the web. In other embodiments, only a portion of the support arm is supported by the first flange of the grid member. For example, in some embodiments, the support arm is only supported along the outer edge of the flange of the grid beam. Still in other embodiments, the support arm extends over the flange of the grid beam without making contact with the flange. For example, in some embodiments, the attachment wall of the bracket is secured to the grid beam such that the support arm extends over the flange but is spaced therefrom.

In certain embodiments of the ceiling system as otherwise described herein, the foot of the first bracket is secured against the first side of the first ceiling panel. For example, as shown in FIG. 4, foot 150 of bracket 100 is attached to the first side 176 along the top of ceiling panel 170. Accordingly, ceiling panel 170 extends along its width 174 away from bracket 100 and the ceiling grid. The location of foot 150 attached to first side 176 can help obscure both foot 150 and the rest of bracket 100 from the view of any positioned below the ceiling grid.

As shown in FIG. 5, with foot 150 of bracket 100 attached along first side 176 of ceiling panel 170, ceiling panel 170 forms an angle $\beta$ with respect to the ceiling grid that is a complementary angle to the angle $\alpha$ of foot 150. For example, in embodiments where the angle between the foot and the support arm is 30 degrees, and the foot is attached to the upper side of the ceiling panel, the ceiling panel may be disposed at an opposing angle of 60 degrees. On the other hand, in other embodiments, the foot is secured to the face of the ceiling panel, rather than the side. Accordingly, in such embodiments, the angle between the foot and the support arm may be the same as the angle between the ceiling panel and the support arm.

In some embodiments, the angle between the support arm and the foot of the bracket is at least 5 degrees, e.g., at least 10 degrees, e.g., at least 15 degrees. Further, in some embodiments, the angle between the support arm and the foot is no more than 85 degrees, e.g., no more than 80 degrees, e.g., no more than 75 degrees. For example, in some embodiments, the angle between the support arm and the foot is in a range from 15 degrees to 75 degrees, e.g., 20 degrees, 30 degrees, 40 degrees, 45 degrees, 50 degrees, 60 degrees or 70 degrees.

In ceiling system 180, foot 150 is fastened to first ceiling panel 170 using a pair of fasteners, such as screws or bolts. In other embodiments, the foot of the bracket is secured to the first ceiling panel using a single fastener or more than two fasteners. Further, in other embodiments, the foot of the bracket is bonded or adhered to the first ceiling panel. In some embodiments, fasteners that hold the foot to the ceiling panel engage the material forming the outer surface of the ceiling panel. In other embodiments, the fasteners extend through the material that forms the outer surface of the ceiling panel. For example, in some embodiments, the outer surface of the ceiling panel is formed by a shell, and the fasteners pass through the outer shell and are secured on the inside of the shell. For instance, in some embodiments, an internal bracket is disposed inside the outer shell of the ceiling panel. Such an internal bracket may be coupled to the foot of the bracket with the outer shell of the ceiling panel sandwiched between the brackets. Still, in other embodiments, fasteners that hold the ceiling panel to the foot of the bracket may be held in place with washers and nuts positioned inside the outer shell of the ceiling panel.

In certain embodiments of the bracket as otherwise described herein, the foot is formed as a flat plate. For example, as shown in FIGS. 1 through 5, foot 150 is formed as a flat plate that is configured to lie against the wall along the first side 176 of first ceiling panel 170. In other embodiments, the foot may have one or more bends. For example, in some embodiments, the foot may have an L-shaped or U-shaped configuration in order to be secured to more than one surface of the ceiling panel. For instance, embodiments with an L-shaped configuration may be configured to be attached to both the first side and one face of the ceiling panel.

In certain embodiments of the bracket as otherwise described herein, the support arm is formed as a flat plate. Likewise, in some embodiments, the attachment wall is formed as a flat plate. For example, in bracket 100, support arm 110 is formed as a flat plate and attachment wall 120 is also formed as a flat plate that extends upward from the inner edge 116 of support arm 110 so as to be perpendicular to support arm 110. With both the support arm 110 and attachment wall 120 formed as flat plates, the support arm and attachment wall can engage corresponding flat surfaces of the grid beam, as shown in FIG. 3. On the other hand, in other embodiments, either or both of the attachment wall and support arm may have a configuration other than a flat plate. For example, these portions of the bracket may be formed as curved plates, wire frames, rods, or other shapes.

In certain embodiments of the bracket as otherwise described herein, the support arm and the foot are angled about a lateral axis that is perpendicular to the attachment wall. For example, the angle of foot 150 in bracket 100, as shown in FIGS. 2 and 4 is measured about an axis that is perpendicular to the attachment wall and to the web of the grid beam. Accordingly, a ceiling panel attached to the bracket and arranged with its length substantially perpendicular to the grid beam may have the width of its front and rear faces angled with respect to the plane of the ceiling grid. In other embodiments, the foot may be angled with respect to the support arm about a different axis. For example, the foot may be angled about a different axis in order to hold a ceiling panel at an angle where the ceiling panel extends parallel to the first grid beam or diagonally across the first grid beam.

In certain embodiments of the bracket as otherwise described herein, the foot is laterally offset from the support arm. For example, as shown in FIG. 3, foot 150 extends laterally outward from leg 130 in the opposite direction of support arm 110, such that foot 150 is laterally offset from support arm 110 in the direction that is perpendicular to grid beam 160. In other embodiments, such as in FIGS. 7-9 described below, the foot may be at least partially aligned under the support arm. For example, the leg may extend under the support arm, or the foot may project in the opposite direction as that shown in FIG. 3, such that the foot extends under the support arm.

In certain embodiments of the bracket as otherwise described herein, the support arm, attachment wall, leg, and foot are formed in a single integral piece. For example, in some embodiments, the support arm, attachment wall, leg, and foot are formed from a bent metal sheet. For example, bracket 100, shown in FIGS. 1-5 is formed from a single cut metal sheet that is bent to form the shape of the bracket. The term metal sheet, as used herein, is not limited to any particular thickness, and may otherwise be referred to as sheet metal, metal plate, or metal foil. In some embodiments, the bracket may include apertures, such as to receive fasteners. Such apertures may be provided in the material of the bracket when it is cut, before or after it is cut, or before or after the material is bent.

In certain embodiments of the bracket as otherwise described herein, a width of the support arm is substantially the same as a width of the attachment wall. For example, in bracket 100, support arm 110 and attachment wall 120 are formed from a rectangular portion of material with a single bend along inner edge 116. Accordingly, the widths 114, 124 of support arm 110 and attachment wall 120 are the same. In other embodiments, the widths of the support arm and attachment wall may be different. For example, in some embodiments the width of the support arm may be greater than the width of the attachment wall so that the grid beam can provide greater vertical support to the support arm. In other embodiments, the width of the attachment wall may be greater than the width of the support arm, so that the connection between the attachment wall and the grid member can be enhanced.

In certain embodiments of the bracket as otherwise described herein, a width of the foot is substantially the same as a width of the support arm. For example, in bracket 100, width 154 of foot 150 is substantially equal to width 114 of support arm 110. Having the width of the support arm and the foot be similar may allow for a reduction in the amount of material used to form the bracket, as the blanks for a number of brackets can be cut from a single sheet in a row, thereby minimizing wasted material between the cut blanks. On the other hand, the width of the foot may be different from that of the support arm. For example, in some embodiments, the width of the foot may be selected based on the thickness of a ceiling panel that will be held by the bracket. If such a width does not provide an adequate connection to the grid beam, the widths of the support arm and the attachment wall may be larger than the width of the foot, to provide a larger connection area. Likewise, the connection between the foot and the ceiling panel can be increased by increasing the length of the foot without the need to have the foot extend past the edges of the ceiling panel.

In certain embodiments of the bracket as otherwise described herein, a width of the leg is less than a width of the foot. For example, in bracket 100, the width 134 of leg 130 is smaller than the width 154 of foot 150. This decreased width of leg 130 compared to both foot 150 and the thickness of the attached ceiling panel helps obscure leg 130 from anyone viewing the ceiling system from below.

In certain embodiments of the bracket as otherwise described herein, the foot is coupled to the leg at a selectable angle. For example, in some embodiments, the attachment wall, support arm, and leg are part of a grid attachment structure, and the foot is part of a panel attachment structure that is removably coupled to the grid attachment structure so as to form the selectable angle.

Figure 7:
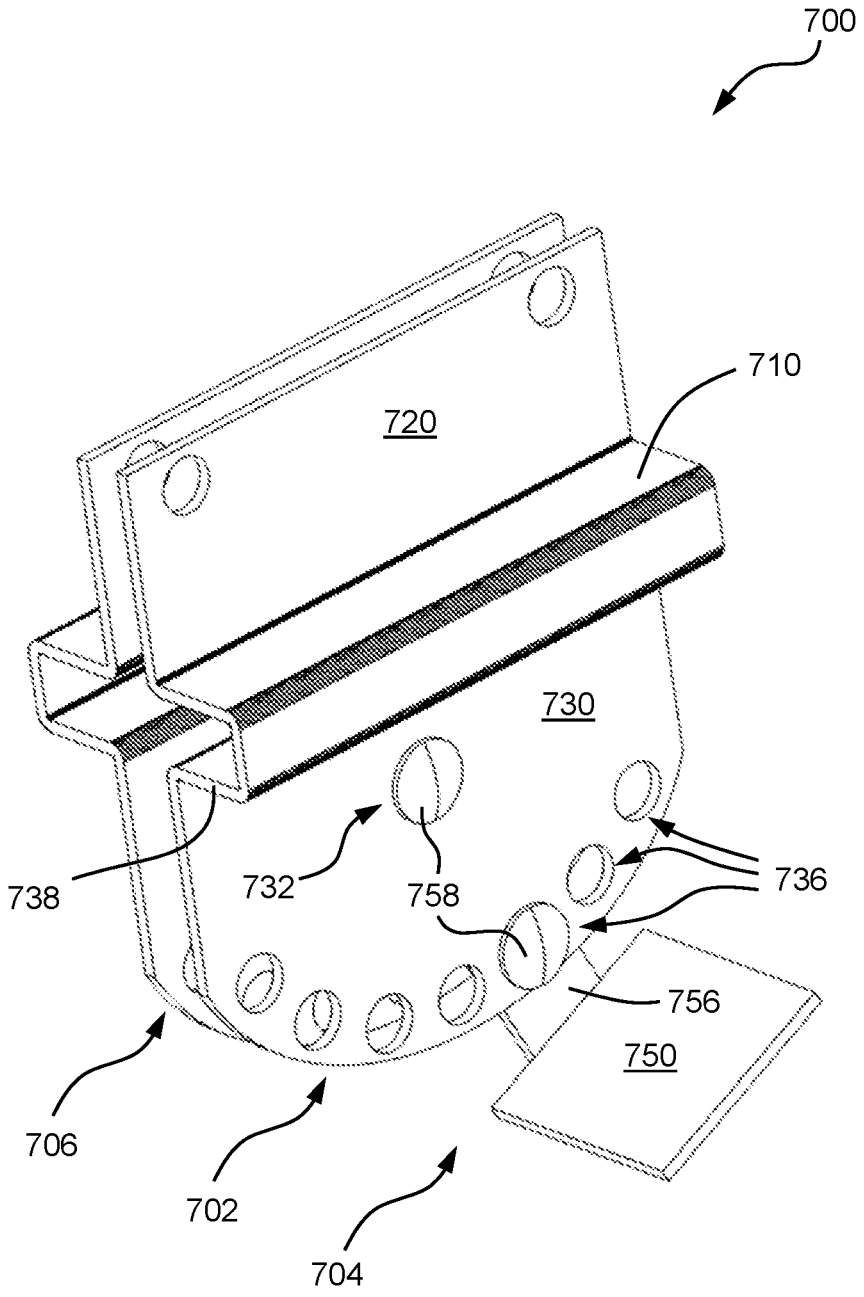
FIG. 7 is a schematic perspective view of a bracket according to another embodiment of the disclosure.
Figure 8:
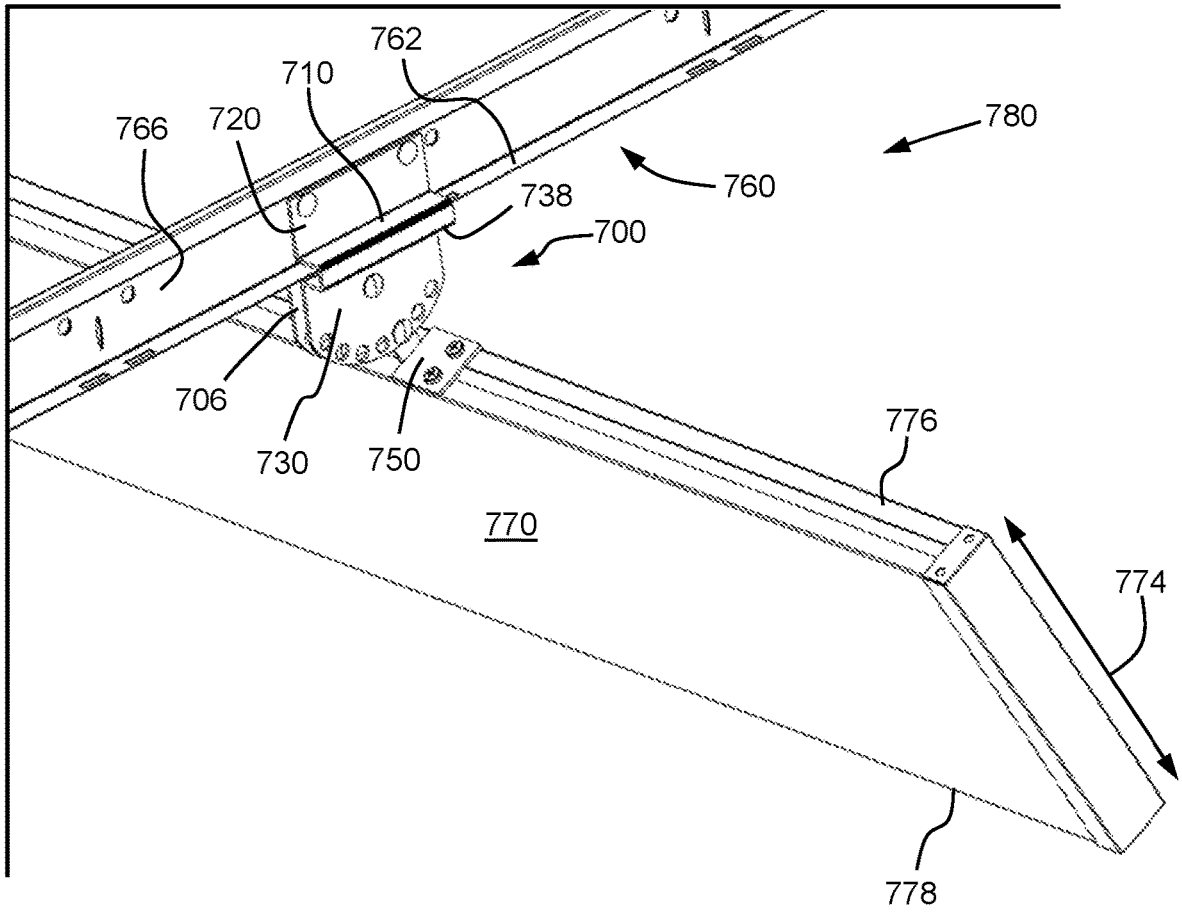
FIG. 8 is a schematic perspective view of a portion of a ceiling system including the bracket of FIG. 7 according to an embodiment of the disclosure.

Such an embodiment is shown in FIGS. 7 and 8. Bracket 700, shown in FIG. 7, includes a support arm 710 configured to extend over a first flange of a grid beam, as explained further below. An attachment wall 720 extends up from support arm 710 and is configured to be secured to a web of the grid beam. Opposite attachment wall 720, a leg 730 extends down from support arm 710 so as to hang below the grid beam. Each of support arm 710, attachment wall 720, and leg 730 are part of a grid attachment structure 702 that is configured to be secured to a grid beam. Bracket 700 also includes a panel attachment structure 704 including a foot 750 that is configured to be attached to a ceiling panel. Panel attachment structure 704 is removably coupled to grid attachment structure 702 in order to form the selectable angle.

FIG. 8 shows a portion of a ceiling system 780 that uses bracket 700. Ceiling system 780 includes a first grid beam 760 with a first bracket 700 coupled thereto. In particular, bracket 700 is positioned with attachment wall 720 secured to the web 766 of first grid beam 760. Support arm 710 extends over the first flange 762 of first grid beam 760 and leg 730 extends down below grid beam 760. Ceiling system 780 also includes a first ceiling panel 770 coupled to the foot 750 of bracket 700. Ceiling panel 770 extends across a width 774 from a first side 776 to a second side 778, and foot 750 is attached to the first side 776 of ceiling panel 770. The position of foot 750 with respect to leg 730 defines the angle of ceiling panel 770, as explained in more detail below.

In certain embodiments of the bracket as otherwise described herein, the panel attachment structure includes a post extending up from the foot that is coupled to the leg of the grid attachment structure. For example, panel attachment structure 704 of bracket 700 includes a post 756 attached to foot 750. Post 756 is attached to leg 730 using a pair of fasteners 758 that set the orientation of panel attachment structure 704 and, thus, the angle of foot 750 and ceiling panel 770.

In certain embodiments of the bracket as otherwise described herein, the leg includes a series of apertures for adjusting a position of the post so as to secure the foot at the selectable angle. For example, leg 730 of bracket 700 includes an upper aperture 732 and a series of lower apertures 736. The post 756 is secured to leg 730 with a fastener 758 that extends through upper aperture 732 and one of the lower apertures 736 in the series of lower apertures. By choosing one of the selectable lower apertures 736 the angle of the post 756 and foot 750 can be selected. While leg 730 of bracket 700 includes a single upper aperture 732 and a series of lower apertures 736, in other embodiments, the leg of the bracket includes a single lower aperture and a series of upper apertures. By selecting the upper aperture for attachment with the post, the angle of the foot may be selected in a similar manner as with bracket 700. Further still, in some embodiments, the bracket includes a series of upper apertures and a series of lower apertures.

In certain embodiments of the bracket as otherwise described herein, the series of apertures is arranged in an arc. For example, the series of lower apertures 736 of bracket 700 are arranged at various positions along an arc, which allows the post 756 to be set at any of a group of different angles. In leg 730, the arc of lower apertures 736 extends to either side of the vertical axis. Accordingly, a ceiling panel attached to bracket 700 can be rotated to angles on either side of the vertical axis without rearranging bracket 700 on the grid beam. In other embodiments, the series of apertures are only arranged on one side of the vertical axis. In such a case, the ceiling panel can be angled in the opposite direction by securing the bracket to the grid beam in the opposite direction. Further, in some embodiments, the series of apertures have a symmetrical configuration about the vertical axis. In such a case, the selectable angles can be chosen regardless of the orientation of the bracket on the grid beam. In other embodiments, the apertures on one side of the vertical axis may be at different angles than the apertures on the other side of the vertical axis, such that intermediate angles can be selected by orienting the bracket in the opposite direction on the grid beam.

In certain embodiments of the bracket as otherwise described herein, the bracket includes a lateral projection between the support arm and the leg, and the lateral projection is configured to extend under the flange of the grid beam such that the leg is positioned below the grid beam. For example, as shown in FIG. 7, bracket 700 includes a lateral projection 738 between support arm 710 and leg 730. The lateral projection 738 extends down and inward from support arm 710 so as to pass under the first flange 762 of the first grid beam 760, as shown in FIG. 8. The use of lateral projection 738 allows part of foot 750 to be positioned underneath grid beam 760.

While the illustrated embodiment of the lateral projection is included in bracket 700, which includes a separate grid attachment structure 702 and panel attachment structure 704, in other embodiments, a lateral projection is included in bracket configurations that are formed as a single piece.

In certain embodiments of the bracket as otherwise described herein, the bracket includes a second grid attachment structure including a second support arm configured to extend over a second flange of the grid beam and a second leg extending down from the second support arm, and wherein the panel attachment structure is also removably coupled to the second grid attachment structure. For example, bracket 700 includes a second grid attachment structure 706 configured to attach to the opposite side of the grid beam. The post 756 of panel attachment structure 704 is positioned between the first grid attachment structure 702 and the second grid attachment structure 706 and is secured by fasteners 758 that extend through both grid attachment structures. As shown in FIG. 8, second grid attachment structure 706 is positioned on the opposing side of first grid beam 760. Accordingly, the attachment wall of second grid attachment structure 706 is secured to an opposite side of the web of first grid beam 760 and the support arm of second grid attachment structure 706 extends over the second flange of the first grid beam 760.

In certain embodiments of the bracket as otherwise described herein, the support arm has a width of at least ½ inch, e.g., at least 1 inch. Further, in some embodiments, the support arm has a width of no more than 8 inches, e.g., no more than 6 inches. For example, in some embodiments, the support arm has a width in a range from ½ inch to 8 inches, e.g., from 1 inch to 6 inches.

In certain embodiments of the bracket as otherwise described herein, the support arm has a depth of at least ⅛ inch, e.g., at least 3/16 inch. Further, in some embodiments, the support arm has a depth of no more than 1 inch, e.g., no more than ¾ inch. For example, in some embodiments, the support arm has a depth in a range from ⅛ inch to 1 inch, e.g., from 3/16 inch to ¾ inch. Further, in some embodiments of the ceiling system of the disclosure, the depth of the support arm is substantially the same as the outward lateral extension of the first flange of the first grid beam. For example, in some embodiments, the depth of the support arm is in a range of 1 to 1.5 times the lateral extension of the first flange of the first grid beam. For example, as shown in FIG. 3, the depth 112 of support arm 110 is slightly greater than the lateral extension of first flange 162, such that the outer edge 118 of support arm 110 extends slightly past the edge of first flange 162.

In certain embodiments of the bracket as otherwise described herein, the attachment wall height is at least ½ inch, e.g., at least ¾ inch. Further, in some embodiments, the attachment wall height is no more than 3 inches, e.g., no more than 2.5 inches. For example, in some embodiments, the height of the attachment wall is in a range from ½ inch to 3 inches, e.g., from ¾ inch to 2.5 inches. Further, in some embodiments of the ceiling system of the disclosure, the height of the attachment wall is substantially the same as the height of the web of the first grid beam. For example, in some embodiments, the height of the attachment wall is in a range of 0.5 to 1.0 times the height of the web of the first grid beam. For example, as shown in FIG. 3, the height 122 of attachment wall 120 is slightly less than the height of web 166 of first grid beam 160 such that attachment wall 120 can fit between first flange 162 and bulb 168.

In certain embodiments of the bracket as otherwise described herein, the foot has a width of at least ½ inch, e.g., at least ¾ inch, e.g., at least 1 inch. Further, in some embodiments, the foot has a width of no more than 6 inches, e.g., no more than 5 inches, e.g., no more than 4 inches. For example, in some embodiments the foot has a width in a range from ½ inch to 6 inches, e.g., from ¾ inch to 5 inches, e.g., from 1 inch to 4 inches. Further, in some embodiments of the ceiling system of the disclosure, the width of the foot of the first bracket is substantially the same as the thickness of the first ceiling panel. For example, in some embodiments, the width of the foot is in a range of 0.5 to 1.0 times the thickness of the first ceiling panel. For example, as shown in FIG. 4, the foot 150 of bracket 100 extends substantially across the thickness of ceiling panel 170. Configuring the foot with a width that is no more than the thickness of the ceiling panel can help to obscure the foot from view by a person below the ceiling panel. On the other hand, configuring the foot with a width that is close to the thickness of the ceiling panel provides added surface area for securing the ceiling panel to the foot.

In certain embodiments of the bracket as otherwise described herein, the foot has a length of at least 1 inch, e.g., at least 1.5 inches. Further, in some embodiments, the foot has a length of no more than 8 inches, e.g., no more than 6 inches. For example, in some embodiments, the foot has a length in a range from 1 inch to 8 inches, e.g., from 1.5 inches to 6 inches.

In certain embodiments of the bracket as otherwise described herein, the support arm has a thickness of at least 10 thousandths of an inch, e.g., at least 20 thousandths of an inch. Further, in some embodiments, the support arm has a thickness of no more than ¼ inch, e.g., no more than ⅛ inch. For example, in some embodiments, the support arm has a thickness in a range from 10 thousandths of an inch to ¼ inch, e.g., from 20 thousandths of an inch to ⅛ inch. Further, in some embodiments, the bracket has a substantially uniform thickness. For example, in some embodiments, the bracket is formed from a plate or sheet with a single thickness. In other embodiments, different portions of the bracket have different material thickness. For example, in some embodiments, one or more of the attachment wall, support arm, leg, or foot has a greater or smaller thickness than the others.

Likewise, in some embodiments, where the bracket includes a panel attachment structure and a grid attachment structure, such as the embodiments shown in FIGS. 7 and 8, the material thickness of the panel attachment structure and the grid attachment structure are the same. In other embodiments, the material thickness of the panel attachment structure and the grid attachment structure are different. Further still, in some embodiments, the various portions of the grid attachment structure have different material thickness. For example, in some embodiments, at least one of the attachment wall, support arm, or leg has a different material thickness than the others. Likewise, in some embodiments, the various portions of the panel attachment structure have different material thickness. For instance, in some embodiments, the material thickness of the foot is thicker or thinner than the material thickness of the post.

Figure 6:
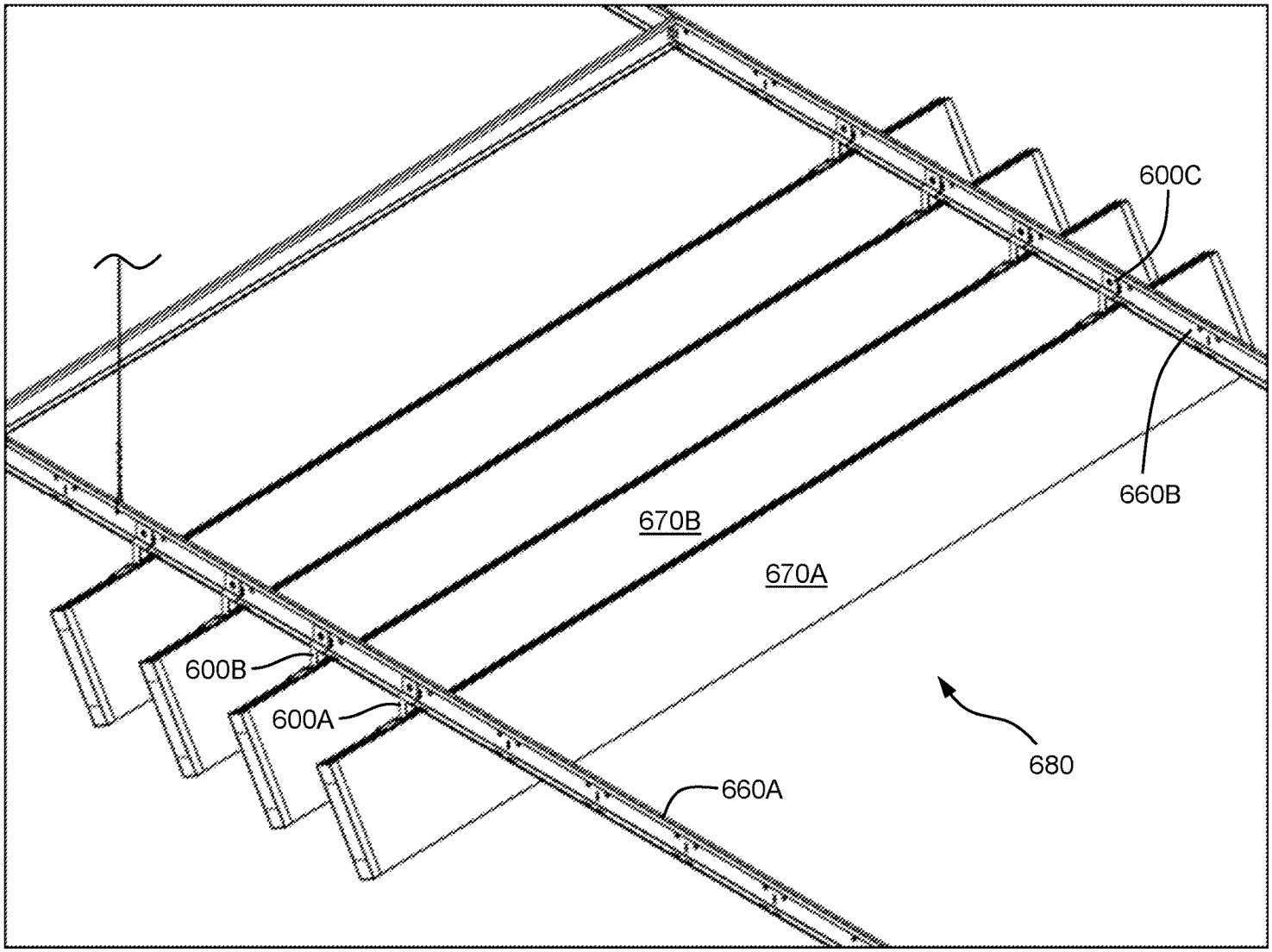
FIG. 6 is a schematic perspective view of a portion of a ceiling system according to another embodiment of the disclosure.
Figure 9:
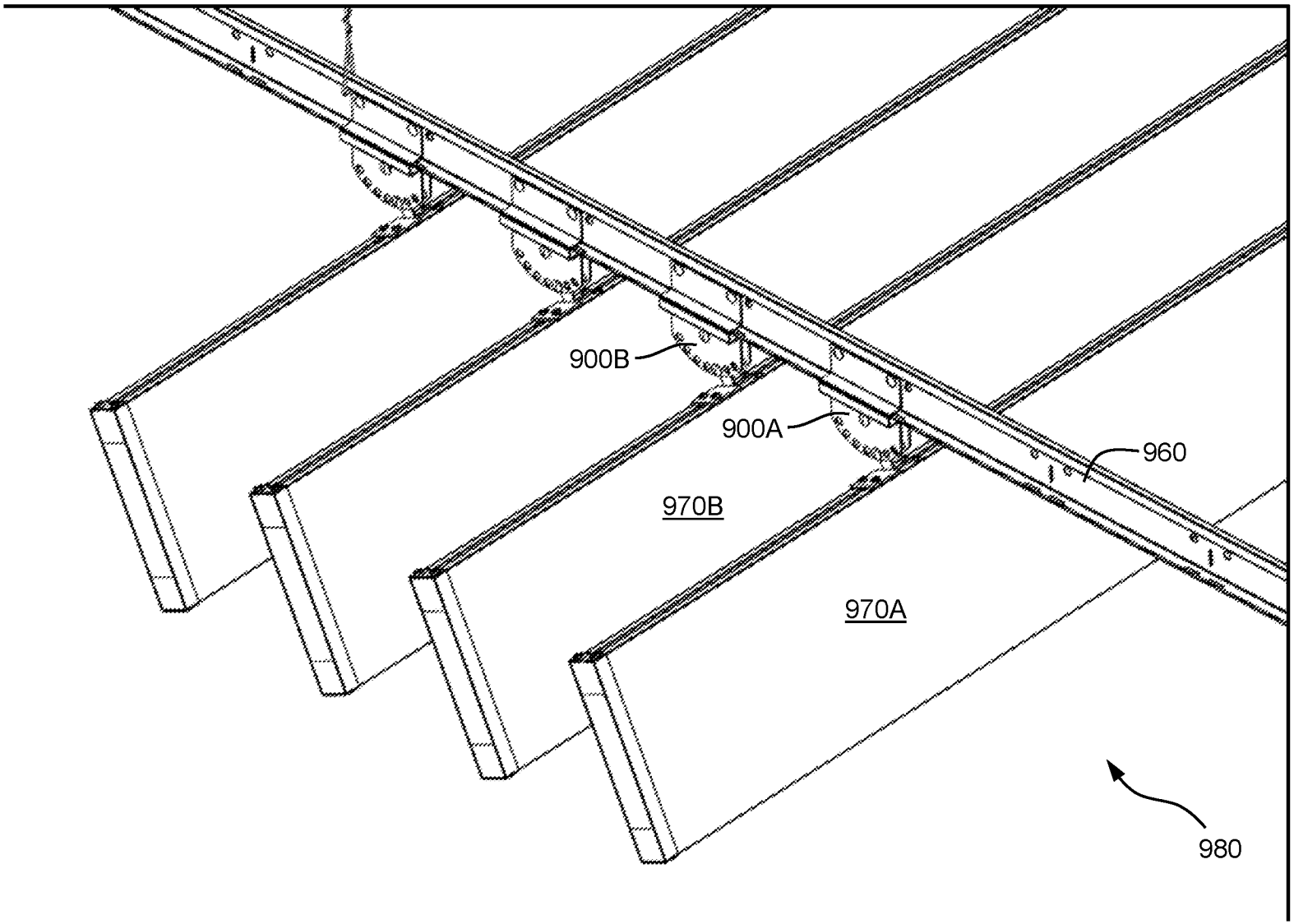
FIG. 9 is a schematic perspective view of a portion of a ceiling system according to another embodiment of the disclosure.

FIGS. 6 and 9 show larger portions of ceiling systems according to the disclosure. FIG. 6 shows a ceiling system 680 that uses brackets 600 with the same configuration as bracket 100, and FIG. 9 shows a ceiling system 980 that uses brackets 900 having the same configuration as bracket 700. While all of the brackets in ceiling system 680 of FIG. 6 have the same configuration, and all of the brackets in ceiling system 980 of FIG. 9 have the same configuration, in other embodiments, the ceiling system may use a variety of different brackets with different configurations. For example, in some embodiments, the ceiling system includes a number of brackets with a fixed angle of the foot and a number of brackets with a selectable angle of the foot.

In certain embodiments of the ceiling system as otherwise described herein, the ceiling system includes a second bracket according to the disclosure coupled to the first grid beam and a second ceiling panel, where the foot of the second bracket is attached to the second ceiling panel. For example, ceiling system 680 shown in FIG. 6 includes a first grid beam 660A with a first bracket 600A and a second bracket 600B coupled thereto. Ceiling system 680 also includes a first ceiling panel 670A coupled to the foot of first bracket 600A and a second ceiling panel 670B coupled to the foot of second bracket 600B. The brackets 600A, 600B are both oriented to hold the respective ceiling panels 670A, 670B at an angle to the ceiling grid.

Likewise ceiling system 980 shown in FIG. 9 includes a first grid beam 960 and a first ceiling panel 970A coupled to first grid beam 960 using a first bracket 900A. Ceiling system 980 also includes a second ceiling panel 970B coupled to first grid beam 960 using a second bracket 900B. The first bracket 900A is arranged so that first ceiling panel 970A is at an angle to the ceiling grid, and the second bracket 900B is arranged so that the second ceiling panel 970B is also at an angle to the ceiling grid.

In certain embodiments of the ceiling system as otherwise described herein, the foot of the second bracket holds the second ceiling panel at the same angle as the first ceiling panel. For example, in ceiling system 680 and in ceiling system 980 all of the ceiling panels are oriented at the same angle. In other embodiments, the ceiling panels are arranged at different angles. For example, in some embodiments, the brackets in the ceiling system are constructed to hold the ceiling panels at different angles. Further, in some embodiments, the brackets are adjustable, and may be set so that the ceiling panels have a variety of different angles.

In certain embodiments of the ceiling system as otherwise described herein, the ceiling system includes a second grid beam and another bracket according to the disclosure coupled to the second grid beam, wherein the foot of the other bracket is attached to the first ceiling panel. For example, ceiling system 680, as shown in FIG. 6, includes a second grid beam 660B that supports the ceiling panels. Thus, near the far end of first ceiling panel 670A, another bracket 600C is used to couple first ceiling panel 670A to the second grid beam 660B.

In some embodiments, the other bracket has the same configuration as the first bracket. For example, in ceiling system 680 the other bracket 600C is attached to the near side of second grid beam 660B and has the same configuration as bracket 600A. In other embodiments, the brackets may have different configurations. For example, in some embodiments, the other bracket has a mirror configuration to the first bracket. For example, in some embodiments, brackets at opposing ends of the ceiling panel are configured as a mirror-image to one another so that the attachment is symmetrical over the length of the ceiling panel. For example, in some embodiments the two brackets near opposing ends of the ceiling panel both extend toward the respective ends of first ceiling panel and hold first ceiling panel at the same angle. In other embodiments, brackets used to attach a ceiling panel to different grid beams have the same configuration, and are positioned on the same side of the respective grid beams.

On the other hand, in other embodiments both brackets have the same configuration, and are positioned on the same side of the first and second grid beams so that they may hold the first ceiling panel at the same orientation. Still, in other embodiments, the brackets have a symmetrical configuration, and may hold a ceiling panel angled at either direction regardless of which side of the grid beam the bracket is attached to.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

EMBODIMENTS

Embodiment 1. A bracket configured to couple a ceiling panel to a ceiling grid, the bracket comprising:

- a support arm configured to extend over a first flange of a grid beam of the ceiling grid;
- an attachment wall extending up from the support arm, the attachment wall being configured to be secured to a web of the grid beam;
- a leg extending down from the support arm so as to hang below the grid beam; and
- a foot coupled to the leg and configured to be attached to the ceiling panel, the foot being disposed at a first angle with respect to the support arm so as to hold the ceiling panel at an angle to the ceiling grid.

Embodiment 2. The bracket according to embodiment 1, wherein the foot is formed as a flat plate.

Embodiment 3. The bracket according to embodiment 1 or embodiment 2, wherein the support arm is formed as a flat plate.

Embodiment 4. The bracket according to any of embodiments 1 to 3, wherein the attachment wall is formed as a flat plate.

Embodiment 5. The bracket according to any of embodiments 1 to 4, wherein the support arm and the foot are angled about a lateral axis that is perpendicular to the attachment wall.

Embodiment 6. The bracket according to any of embodiments 1 to 5, wherein the foot is laterally offset from the support arm.

Embodiment 7. The bracket according to any of embodiments 1 to 6, wherein the support arm, attachment wall, leg, and foot are formed in a single integral piece.

Embodiment 8. The bracket according to any of embodiments 1 to 7, wherein the support arm, attachment wall, leg, and foot are formed from a bent metal sheet.

Embodiment 9. The bracket according to any of embodiments 1 to 8, wherein a width of the support arm is substantially the same as a width of the attachment wall.

Embodiment 10. The bracket according to any of embodiments 1 to 9, wherein a width of the foot is substantially the same as a width of the support arm.

Embodiment 11. The bracket according to any of embodiments 1 to 10, wherein a width of the leg is less than a width of the foot.

Embodiment 12. The bracket according to any of embodiments 1 to 5, wherein the foot is coupled to the leg at a selectable angle.

Embodiment 13. The bracket according to embodiment 12, wherein the attachment wall, support arm, and leg are part of a grid attachment structure, and wherein the foot is part of a panel attachment structure that is removably coupled to the grid attachment structure so as to form the selectable angle.

Embodiment 14. The bracket according to embodiment 13, wherein the panel attachment structure includes a post extending up from the foot that is coupled to the leg of the grid attachment structure.

Embodiment 15. The bracket according to embodiment 13 or embodiment 14, wherein the leg includes a series of apertures for adjusting a position of the post so as to secure the foot at the selectable angle.

Embodiment 16. The bracket according to embodiment 15, wherein the series of apertures is arranged in an arc.

Embodiment 17. The bracket according to any of embodiments 13 to 16 wherein the bracket includes a second grid attachment structure including a second support arm configured to extend over a second flange of the grid beam and a second leg extending down from the second support arm, and wherein the panel attachment structure is also removably coupled to the second grid attachment structure.

Embodiment 18. The bracket according to any of embodiments 1 to 17, wherein the bracket includes a lateral projection between the support arm and the leg, wherein the lateral projection is configured to extend under the flange of the grid beam such that the leg is positioned below the grid beam.

Embodiment 19. The bracket according to any of embodiments 1 to 18, wherein the support arm has a width of at least ½ inch, e.g., at least 1 inch.

Embodiment 20. The bracket according to any of embodiments 1 to 19, wherein the support arm has a width of no more than 8 inches, e.g., no more than 6 inches.

Embodiment 21. The bracket according to any of embodiments 1 to 20, wherein the support arm has a depth of at least ⅛ inch, e.g., at least 3/16 inch.

Embodiment 22. The bracket according to any of embodiments 1 to 21, wherein the support arm has a depth of no more than 1 inch, e.g., no more than ¾ inch.

Embodiment 23. The bracket according to any of embodiments 1 to 22, to wherein the attachment wall height is at least ½ inch, e.g., at least ¾ inch.

Embodiment 24. The bracket according to any of embodiments 1 to 23, wherein the attachment wall height is no more than 3 inches, e.g., no more than 2.5 inches.

Embodiment 25. The bracket according to any of embodiments 1 to 24, wherein the foot has a width of at least ½ inch, e.g., at least ¾ inch, e.g., at least 1 inch.

Embodiment 26. The bracket according to any of embodiments 1 to 25, wherein the foot has a width of no more than 6 inches, e.g., no more than 5 inches, e.g., no more than 4 inches.

Embodiment 27. The bracket according to any of embodiments 1 to 26, wherein the foot has a length of at least 1 inch, e.g., at least 1.5 inches.

Embodiment 28. The bracket according to any of embodiments 1 to 27, wherein the foot has a length of no more than 8 inches, e.g., no more than 6 inches.

Embodiment 29. The bracket according to any of embodiments 1 to 28, wherein the support arm has a thickness of at least 10 thousandths of an inch, e.g., at least 20 thousandths of an inch.

Embodiment 30. The bracket according to any of embodiments 1 to 29, wherein the support arm has a thickness of no more than ⅜ inch, e.g., no more than ¼ inch.

Embodiment 31. The bracket according to any of embodiments 13 to 30, wherein a material thickness of the panel attachment structure is the same as a material thickness of the grid attachment structure.

Embodiment 32. A ceiling system comprising:

a ceiling grid comprising a first grid beam including a web and a first flange extending laterally from the web;

a first bracket according to any of embodiments 1 to 31 coupled to the first grid beam; and a first ceiling panel having a first face and a second face opposite the first face, the first ceiling panel extending along a length from a first end to a second end and extending across a width from a first side to a second side, wherein the foot of the first bracket is attached to the first ceiling panel.

Embodiment 33. The ceiling system according to embodiment 32, wherein the attachment wall of the first bracket is secured against the web of the first grid beam.

Embodiment 34. The ceiling system according to embodiment 32 or embodiment 33, wherein at least a portion of the support arm of the first bracket is supported by the first flange of the first grid beam.

Embodiment 35. The ceiling system according to any of embodiments 32 to 34, wherein the grid beam is a T-beam.

Embodiment 36. The ceiling system according to any of embodiments 32 to 35, wherein the foot of the first bracket is secured against the first side of the first ceiling panel.

Embodiment 37. The ceiling system according to any of embodiments 32 to 36, wherein the attachment wall, support arm, and leg of the first bracket are part of a first grid attachment structure, and wherein the foot is part of a panel attachment structure that is removably coupled to the first grid attachment structure so as to form the selectable angle.

Embodiment 38. The ceiling system according to embodiment 37, wherein the bracket includes a second grid attachment structure including a second attachment wall secured to an opposite side of the web of the first grid beam, a second support arm extending over the second flange of the first grid beam, and a second leg that is removably coupled to the first grid attachment structure.

Embodiment 39. The ceiling system according to any of embodiments 32 to 38, further comprising a second bracket according to any of embodiments 1 to 31 coupled to the first grid beam; and a second ceiling panel, wherein the foot of the second bracket is attached to the second ceiling panel.

Embodiment 40. The ceiling system according to embodiment 39, wherein the foot of the second bracket holds the second ceiling panel at the same angle as the first ceiling panel.

Embodiment 41. The ceiling system according to any of embodiments 32 to 40, further comprising a second grid beam; and another bracket according to any of embodiments 1 to 31 coupled to the second grid beam, wherein the foot of the other bracket is attached to the first ceiling panel.

Embodiment 42. The ceiling system according to embodiment 41, wherein the other bracket has a mirror configuration to the first bracket.

What is claimed is:

1. A bracket configured to couple a ceiling panel to a ceiling grid, the bracket comprising:

a support arm configured to extend over a first flange of a grid beam of the ceiling grid;

an attachment wall extending up from the support arm, the attachment wall being configured to be secured to a web of the grid beam;

a leg extending down from the support arm so as to hang below the grid beam; and a foot coupled to the leg and configured to be attached to the ceiling panel, the foot being disposed at a first angle with respect to the support arm so as to hold the ceiling panel at an angle to the ceiling grid;

wherein the bracket is a unitary structure of one-piece construction composed of a single piece of material.

2. The bracket according to claim 1, wherein each of the foot, the support arm and the attachment wall is formed as a flat plate.

3. The bracket according to claim 1, wherein the support arm and the foot are angled about a lateral axis that is perpendicular to the attachment wall.

4. The bracket according to claim 1, wherein the foot is laterally offset from the support arm.

5. The bracket according to claim 1, wherein the material is a bent metal sheet.

6. The bracket according to claim 1, wherein the bracket includes a lateral projection between the support arm and the leg, wherein the lateral projection is configured to extend under the flange of the grid beam such that the leg is positioned below the grid beam.

7. The bracket according to claim 1, wherein the foot is coupled to the leg at a selectable angle.

8. The bracket according to claim 7, wherein the attachment wall, support arm, and leg are part of a grid attachment structure, and wherein the foot is part of a panel attachment structure that is removably coupled to the grid attachment structure so as to form the selectable angle.

9. The bracket according to claim 8, wherein the panel attachment structure includes a post extending up from the foot that is coupled to the leg of the grid attachment structure.

10. The bracket according to claim 8, wherein the bracket includes a second grid attachment structure including a second support arm configured to extend over a second flange of the grid beam and a second leg extending down from the second support arm, and wherein the panel attachment structure is also removably coupled to the second grid attachment structure.

11. The bracket according to claim 8, wherein a material thickness of the panel attachment structure is the same as a material thickness of the grid attachment structure.

12. The bracket according to claim 8, wherein the leg includes a series of apertures for adjusting a position of the post so as to secure the foot at the selectable angle.

13. The bracket according to claim 12, wherein the series of apertures is arranged in an arc.

14. A ceiling system comprising:

a ceiling grid comprising a first grid beam including a web and a first flange extending laterally from the web;

a first bracket according to claim 1 coupled to the first grid beam; and a first ceiling panel having a first face and a second face opposite the first face, the first ceiling panel extending along a length from a first end to a second end and extending across a width from a first side to a second side, wherein the foot of the first bracket is attached to the first ceiling panel.

15. The ceiling system according to claim 14, wherein the attachment wall of the first bracket is secured against the web of the first grid beam.

16. The ceiling system according to claim 14, wherein at least a portion of the support arm of the first bracket is supported by the first flange of the first grid beam.

17. The ceiling system according claim 14, wherein the foot of the first bracket is secured against the first side of the first ceiling panel.

18. The ceiling system according to claim 14, further comprising a second bracket coupled to the first grid beam; and a second ceiling panel, wherein a foot of the second bracket is attached to the second ceiling panel.

19. The ceiling system according to claim 14, further comprising a second grid beam; and another bracket coupled to the second grid beam, wherein a foot of the other bracket is attached to the first ceiling panel.

* * * * *